US012241039B2

(12) United States Patent
James et al.

(10) Patent No.: US 12,241,039 B2
(45) Date of Patent: Mar. 4, 2025

(54) GRAPHENE-BASED LUBRICANT ADDITIVES AND LUBRICANTS

(71) Applicant: NanoXplore Inc., Montreal (CA)

(72) Inventors: Allan James, Lansing, MI (US); Hiroyuki Fukushima, Lansing, MI (US); Liya Wang, Lansing, MI (US)

(73) Assignee: NanoXplore Inc., Montreal (CA)

( * ) Notice: Subject to any disclaimer, the term of this patent is extended or adjusted under 35 U.S.C. 154(b) by 0 days.

(21) Appl. No.: 17/799,399

(22) PCT Filed: Feb. 22, 2021

(86) PCT No.: PCT/US2021/018981
§ 371 (c)(1),
(2) Date: Aug. 12, 2022

(87) PCT Pub. No.: WO2021/168394
PCT Pub. Date: Aug. 26, 2021

(65) Prior Publication Data

US 2024/0240103 A1 Jul. 18, 2024

Related U.S. Application Data

(60) Provisional application No. 62/978,970, filed on Feb. 20, 2020.

(51) Int. Cl.
*C10M 169/04* (2006.01)
*C10M 107/02* (2006.01)
(Continued)

(52) U.S. Cl.
CPC ..... *C10M 169/04* (2013.01); *C10M 107/02* (2013.01); *C10M 125/02* (2013.01);
(Continued)

(58) Field of Classification Search
CPC ..... C10M 169/04; C10M 107/02; C10M 125/02; C10M 173/00; C10M 2201/02;
(Continued)

(56) References Cited

U.S. PATENT DOCUMENTS

2010/0092809 A1 4/2010 Drzal et al.
2012/0322694 A1* 12/2012 Monteiro ..... B82Y 30/00 507/131
(Continued)

FOREIGN PATENT DOCUMENTS

JP 2016069482 A * 5/2016
WO 2014189065 A1 11/2014

OTHER PUBLICATIONS

JP2016069482A BIB Translated (Year: 2016).*
(Continued)

*Primary Examiner* — Ellen M McAvoy
*Assistant Examiner* — Chantel Graham
(74) *Attorney, Agent, or Firm* — COOLEY LLP

(57) ABSTRACT

A graphene-based lubricant is provided that includes a graphene-based additive. The graphene-based additive, along with and other optional additives is dispersed in a base liquid. A method of lubrication is also provided that includes the application of the composition to two mating surfaces to form a protective coating between the two mating surfaces.

16 Claims, 4 Drawing Sheets

(51) Int. Cl.

| | |
|---|---|
| ***C10M 125/02*** | (2006.01) |
| ***C10M 173/00*** | (2006.01) |
| *C10N 20/06* | (2006.01) |
| *C10N 30/04* | (2006.01) |

(52) U.S. Cl.
CPC ..... *C10M 173/00* (2013.01); *C10M 2201/02* (2013.01); *C10M 2201/041* (2013.01); *C10M 2201/14* (2013.01); *C10M 2205/0206* (2013.01); *C10N 2020/06* (2013.01); *C10N 2030/04* (2013.01)

(58) Field of Classification Search
CPC ..... C10M 2201/041; C10M 2201/14; C10M 2205/0206; C10N 2020/06; C10N 2030/04
See application file for complete search history.

(56) References Cited

U.S. PATENT DOCUMENTS

| | | | | |
|---|---|---|---|---|
| 2017/0088788 | A1 | 3/2017 | Huang et al. | |
| 2017/0175023 | A1* | 6/2017 | Hasegawa ..... | C08K 3/04 |
| 2018/0298303 | A1 | 10/2018 | Opalka et al. | |

OTHER PUBLICATIONS

JP2016069482A Claims Translated (Year: 2016).*
JP2016069482A Description Translated (Year: 2016).*
Int'l Search Report for PCT/US2021/018981, dated Jun. 11, 2021.

* cited by examiner

GRAPHENE-BASED LUBRICANT ADDITIVES AND LUBRICANTS

RELATED APPLICATIONS

This application is a U.S. National Phase application, filed under U.S.C. § 371, of International Application No. PCT/US2021/018981, filed Feb. 22, 2021, which claims the benefit of and priority to U.S. Provisional Application No. 62/978,970, filed Feb. 20, 2020, the contents of which are hereby incorporated by reference.

TECHNICAL FIELD

The present invention generally relates to the field of lubricant materials, and more specifically to graphene-based additives and lubricants for lubrication applications.

BACKGROUND

Friction and its reduction play an important role in our modern way of life. Friction is the resistance to relative motion between two bodies in contact. It occurs at all interfaces, especially where there is sliding, rolling, impacting, or rotating. At the macroscopic level, all surfaces are rough and surface peaks may bond to one another or protrude into the adjoining surface. The friction reduces energy efficiency of machineries and various industrial processes. Moreover, it causes excessive wear, shortens the life, and even reduces the reliability of those machineries.

Lubricants are used to reduce or control the friction. They keep moving parts apart from each other, help to move heat out of the contact surfaces, keep the surfaces clean, and perform some additional functions. As a result, lubricants can help reduce friction and wear, thereby increasing energy efficiency, improving equipment durability, and reducing mechanical failures.

The most common and effective lubricants are liquid-based lubricants. Liquid lubricants reduce wear and friction of the mechanical systems by forming a low shear, high durability boundary film on the mating surfaces. The most common liquid components in lubricants are hydrocarbon-based oils made by hydro-cracking, solvent extraction, or some other processes. There are also aqueous lubricants. In addition to the base liquid, typical lubricants also contain additives that help perform various functionalities. Typical lubricant additives include anti-oxidants, rust and corrosion inhibitors, viscosity index improvers, anti-wear agents, extreme pressure additives, dispersants, anti-foaming agents, or friction modifier. Different additive packages are developed for specific applications.

However, there exists a need in the art for a lubricant and lubricant additive that provides all of the above described anti-oxidant, rust and corrosion inhibitor, viscosity index improver, anti-wear agent, extreme pressure resistance, dispersant, anti-foaming agent, and friction modifier properties in a single lubricant and lubricant additive without resort to a separate formulation for each property.

SUMMARY OF THE INVENTION

A graphene-based lubricant is provided that includes a graphene-based additive. The graphene-based additive, along with and other optional additives is dispersed in a base liquid.

A method of lubrication is also provided that includes the application of the composition to two mating surfaces to form a protective coating between the two mating surfaces.

BRIEF DESCRIPTION OF THE DRAWING

The present invention is further detailed with respect to the following drawings that are intended to show certain aspects of the present invention, but should not be construed as limit on the practice of the invention, wherein.

DETAILED DESCRIPTION OF THE PREFERRED EMBODIMENTS

Figure 1:
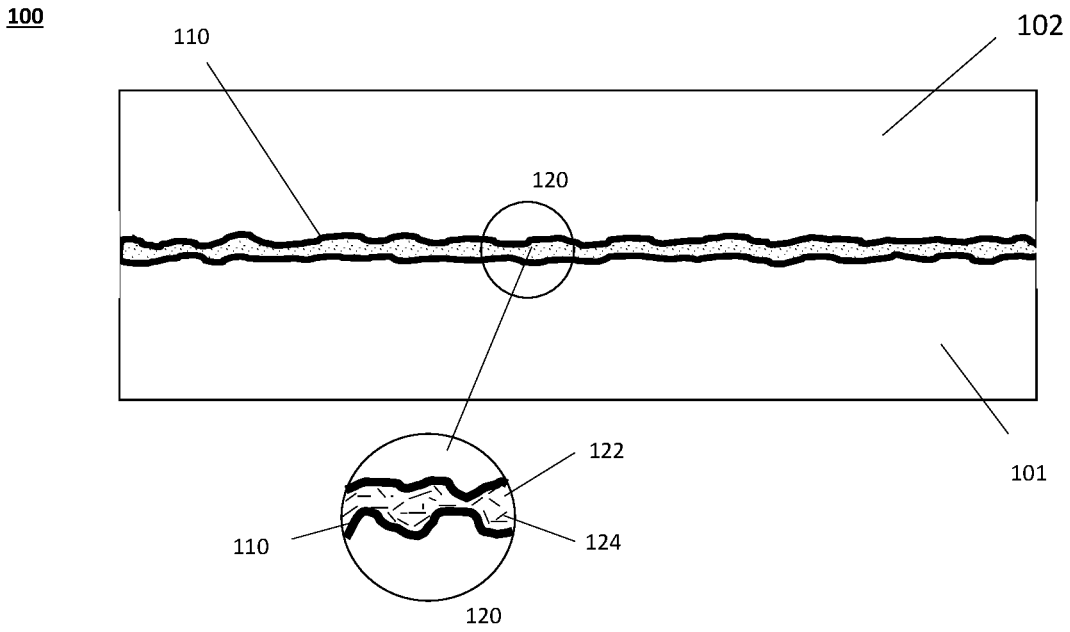
FIG. 1 is a schematic illustration of an inventive lubricant at mating surfaces.

The present invention has utility as graphene-based lubricants for machineries and industrial or commercial processes that involve sliding, rolling, cutting, grinding, honing, turning, polishing, drilling, and stamping. Embodiments of the invention can help reduce wear, decrease friction, enhance heat dissipation, increase energy efficiency, or extend service life of equipment or processes.

Graphene type materials are allotropes of carbon in the form of a two-dimensional, atomic-scale, honey-comb lattice in which one atom forms each vertex. Allotropy or allotropism is the property of some chemical elements to exist in two or more different forms, in the same physical state, known as allotropes of these elements. Allotropes are different structural modifications of an element; the atoms of the element are bonded together in a different manner. Graphene is the basic structural element of other allotropes, including graphite, charcoal, carbon nanotubes and fullerenes. Graphene type materials are highly versatile materials with unique properties in terms of mechanical strength, electrical conductivity and thermal conductivity.

According to embodiments of the present invention, graphene type materials, as a new class of 2 dimensional nanomaterials, are well suited for lubrication applications either as a solid lubricant or as an additive in liquid lubricants due to its high chemical inertness, excellent thermal conductivity, high strength, ultra-thin thickness, atomic scale smoothness, and easy shearing capability.

The nano size and 2-dimensional features of graphene type materials make it surprisingly well-suited for lubrication applications according to embodiments of the present invention. Like many other 2-dimensional materials, atoms in graphene type materials are connected with covalent bonds in the same layer and by Van de Waals force between layers. As a result, the materials have high in-plane strength but low shear resistance between layers. Moreover, such materials are often at nanoscale, especially in the flake thickness direction. Such unique features offer great advantages in reducing friction and wear at interfaces.

For example, one of the functionalities enhanced by additives is anti-wear, especially under extreme pressure. Such additives help form a thin film or coating on the mating surfaces to separate them apart. This can improve their resistance toward wear, especially under heavy loading or in the case of film break. It has been discovered that graphene's easy shearing can help reduce friction; its small size and flexibility can help create a thin film; and its high load-carrying capability can help maintaining the lubrication film, thus resulting in an enhanced and improved lubricant.

Another functionality of lubricant additive is corrosion protection. According to embodiments, the 2-dimensional thin flake morphology of graphene type materials help form a protective film on the mating surfaces to reduce the rust and corrosion. Moreover, some graphene type materials are highly hydrophobic, which help reduce moisture absorption and hence corrosion. This is important for certain applications such as stamping or forming where processed parts often need to be left there for days with residual lubricants on the surface before being cleaned for the next process such as assembly or painting.

According to embodiments of the instant invention, graphene type materials are applied as additive in liquid lubricants. The graphene-based lubricants significantly improve the performance as compared to conventional lubricants due to their good film forming capability, intrinsic lubricating property, high mechanical strength and load-carrying capability, good barrier property, and excellent thermal conductivity. Lubricants according to embodiments of the present invention can be applied in various machineries and equipment such as consumer products, gears, brakes, bearings, and engines. It can also be applied to industrial processes of rolling, cutting, grinding, honing, turning, polishing, drilling, and stamping.

As used herein, graphene type materials are defined as two-dimensional material constructed by close-packed carbon atoms including single-layer graphene, double-layer graphene, few-layer graphene (FLG), graphene nanoplatelets (GNP), graphene oxide (GO), reduced graphene oxide (rGO), functionalized graphene, doped graphene, and a combination thereof.

As used herein, single-layer graphene is defined as a single layer of carbon atoms covalently bonded each other to form two-dimensional layer.

As used herein, double-layer graphene is defined as a stack graphene of two layers.

As used herein, few-layer graphene (FLG), is defined as a stack graphene of 3-10 layers.

As used herein, graphene nanoplatelet is defined as a stack of graphene of more than 10 layers.

As used herein, graphene oxide is defined as one or more graphene layers with various oxygen-containing functionalities introduced in their basal planes such as epoxide, carbonyl, carboxyl, and hydroxyl groups with a typical C:O ratio in between 8:2 to 4:6.

As used herein, reduced graphene oxide is defined as graphene oxide that has been chemically or thermally reduced with a total oxygen content of typically in the range of 10%-30% depending on the extent of reduction.

As used herein, functionalized graphene is defined as single-layer graphene, double-layer graphene, few-layer graphene (FLG), graphene nanoplatelets (GNP), graphene oxide, and reduced graphene oxide that are attached certain chemical groups at their surfaces or edges. The chemical groups include, but not limited to, epoxide, carbonyl, carboxyl, hydroxyl, amine, phenyls, fluorine, halogens, silicones, silane coupling agents, vinyls, dienes, aliphatic chains, acrylics, molecules with aromatic rings, curing agents, cellulose, modified cellulose, etc.

As used herein doped graphene is defined as single-layer graphene, double-layer graphene, few-layer graphene (FLG), graphene nanoplatelets (GNP), graphene oxide, and reduced graphene oxide that are doped with certain metallic or non-metallic elements such as metals, ions, nitrogen, fluorine, oxygen, halogens, silicon, etc. The graphene type materials can be made by chemical vapor deposition, epitaxial growth, pyrolysis, chemical synthesis, chemical exfoliation, mechanical exfoliation, exfoliation in a liquid by sonication, etc. The graphene type materials can also be made by oxidizing graphite with or without a reduction step.

These graphene-based nanoparticles consist of small stacks of graphene that are typically 1 to 15 nanometers thick, with diameters ranging from sub-micrometer to 100 micrometers. U.S. Patent Publication 2010/0092809 describes an exemplary process for forming exfoliated graphite nanoparticles.

As illustrated in FIG. 1, embodiments of a graphene-based liquid lubricant is used in a lubrication system (Block 100) between two mating surfaces 101, 102. Graphene helps form a protective coating 110 on the surfaces due to its nano size and 2-dimensional morphology. Such a protective film helps reduce the wear of the mating surfaces due to the high mechanical strength and load-carrying capability of graphene-based materials. Additionally, the film also helps reduce friction due to the excellent lubricating property of graphene surface as well as its easy shearing feature between the graphene layers. Moreover, graphene 124 is also dispersed in the base liquid 122 at the interface 120. Such graphene can help repair damaged graphene coating on the surfaces. Furthermore, the graphene significantly improves the thermal conductivity of the base liquid, allowing to quickly remove or spread the heat generated at the contact points. The enhanced cooling effect helps reduce the wear and extend the service life of parts or tools that are involved.

A critical requirement for graphene-based lubricants is good dispersion. Good dispersion not only improves the filling and coating capabilities of the graphene on the mating surfaces, but also helps reduce particle settling. The particle size, flake thickness, morphology, and surface/edge chemistry of graphene type materials all affect the dispersion. For example, smaller particle size is favorable for filling, smoothing, or forming a thin coating on the mating surfaces.

In some inventive embodiment, graphene is modified with various functional groups to improve the dispersion. According to embodiments, the graphene is functionalized with long alkyl chains or aromatic containing hydrocarbon chains before being dispersed in a non-polar oil medium. Surfactants are such a class of materials for dispersion improvement. Surfactants molecules are attached to the surface of graphene-based additives without changing the formulation of the base liquid. According to embodiments, surfactants for graphene dispersion include but not limited to sulfonates, sulfates, phosphonates, phosphates, fatty acids, naphthenic acids, fatty amides, organic alcohols, succinimides, succinate esters, polysaccharides, maleic anhydride, maleic anhydride grafted polyolefins, polyols, polyethylene glycols (PEG), PEG based copolymers, polyacrylic acids (PAA), polyvinyl chloride (PVC), phenoxy ethers, styrene acrylics, etc. According to embodiments, graphene type materials are functionalized by covalently bonding chemical molecules to have better chemical functional groups. The functionalization is achieved by chemically reacting functionalizing agents or plasma treatments. The typical functionalizing agents for graphene dispersion include but not limited to, silanes, alkoxysilanes, organic amines, polyols, epoxies, organic acids, etc.

In some inventive embodiment, dispersants are used to modify the base oil formulation to achieve the same purpose.

Graphene is prone to agglomerating in the base lubricating oil, which limits their ability to lubricate the contact area and this negatively impacts the lubricating effect. According to embodiments, dispersants are used to avoid the agglomeration of graphene type materials. The molecules of dispersants usually have both lipophobic and lipophilic functional groups. The lipophobic part can be absorbed onto the surface of graphene, forming an organic layer that sterically stabilize the graphene additive in the base oil.

Figure 2:
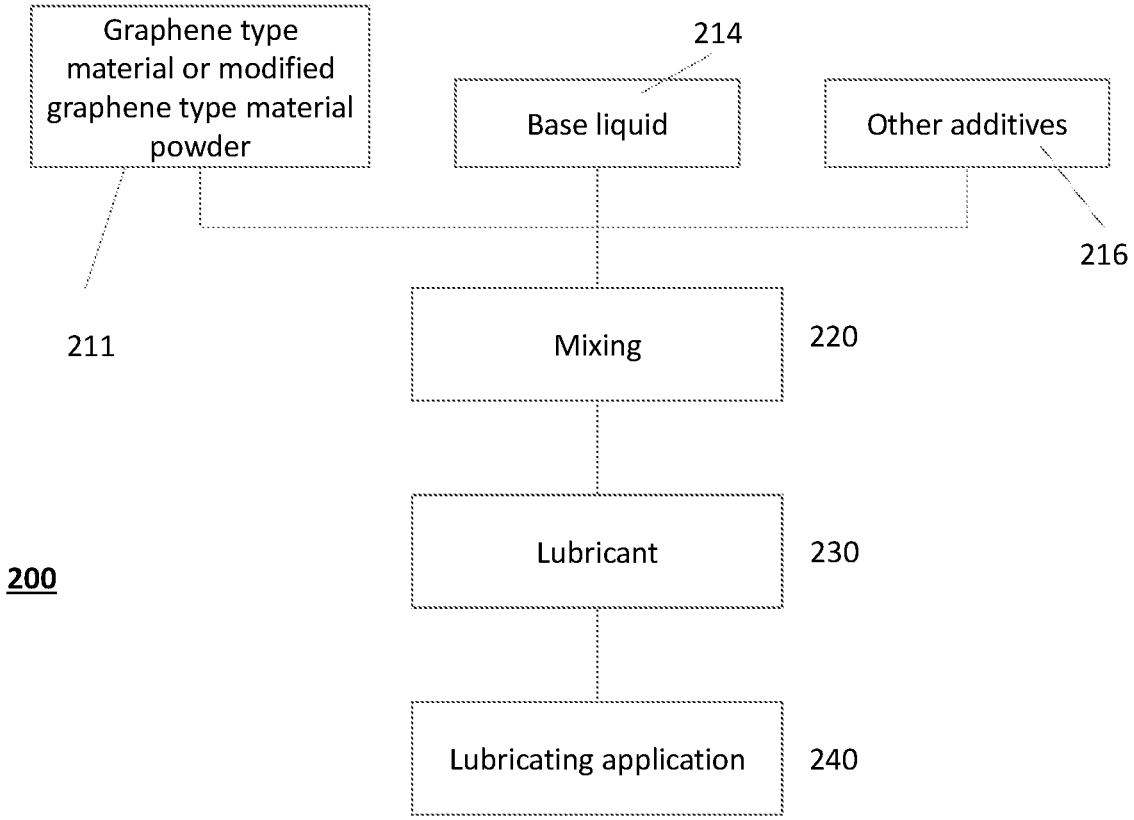
FIG. 2 is a flowchart showing the steps of making graphene-based lubricants using graphene powders according to embodiments of the present invention.

In some inventive embodiment, the graphene type materials are added to the solvent or base liquid mix as a powder as shown in process 200 of FIG. 2. Graphene type materials, including functionalized graphene and doped graphene (Block 211) are mixed (Block 220) with base liquid (Block 214) and other components (Block 216) in the formulation to obtain a lubricant (Block 230). The mixing can be done by any of the conventional mixing equipment including high shear mixer, three-roll mill, attritor mill, high energy mill, double planetary mixer, nozzle mixer, cavity mixer, and other mixers.

Figure 3:
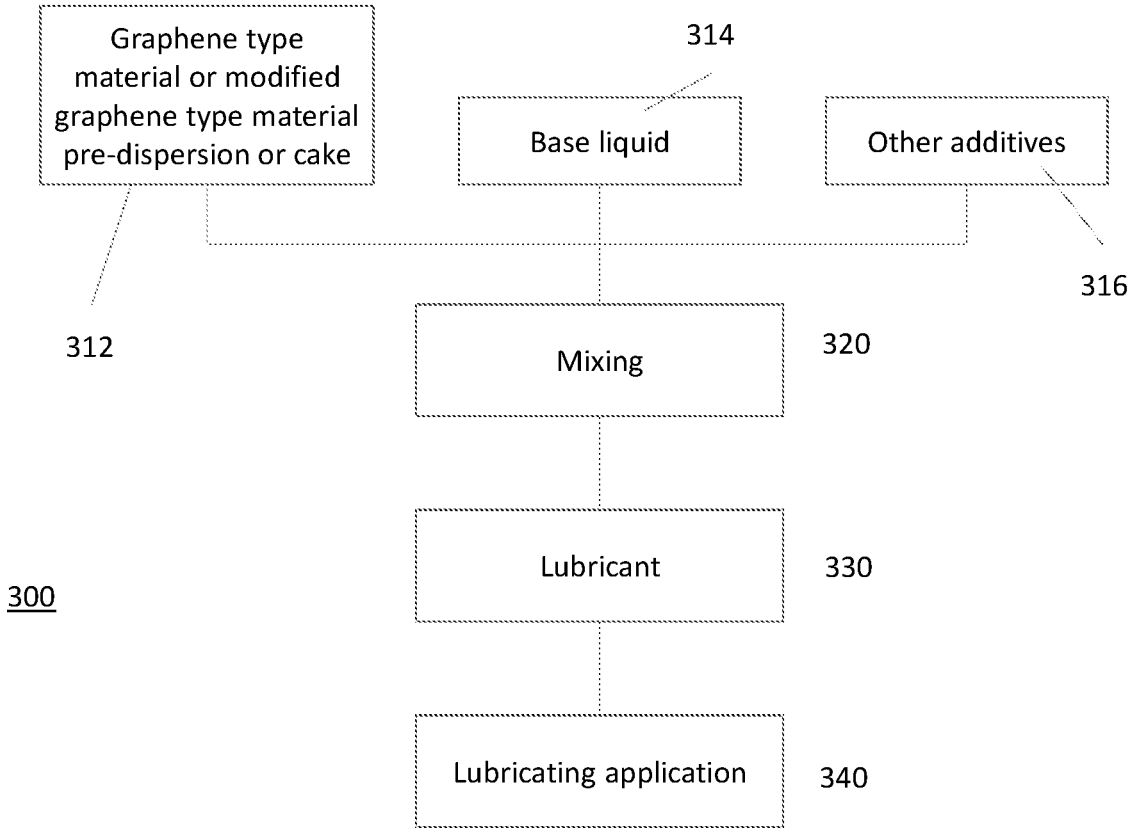
FIG. 3 is a flowchart showing the steps of making graphene-based lubricants using graphene dispersions, concentrates, or cakes according to embodiments of the present invention.

In some inventive embodiment, the graphene type materials are added to the solvent or base liquid mix as a pre-dispersion, a concentrate, or a wet cake as shown in process 300 of FIG. 3. Graphene type materials are first dispersed in a solvent to form a dispersion, a concentrate, or a wet cake (Block 312). The dispersion or cake is then mixed (Block 320) with the base liquid (Block 314) and other components (Block 316) in the formulation to obtain a lubricant (Block 330). The mixing can be done by any of the conventional mixing equipment including high shear mixer, three-roll mill, attritor mill, high energy mill, double planetary mixer, nozzle mixer, cavity mixer, and other mixers.

Exemplary Embodiment 1

Figure 4:
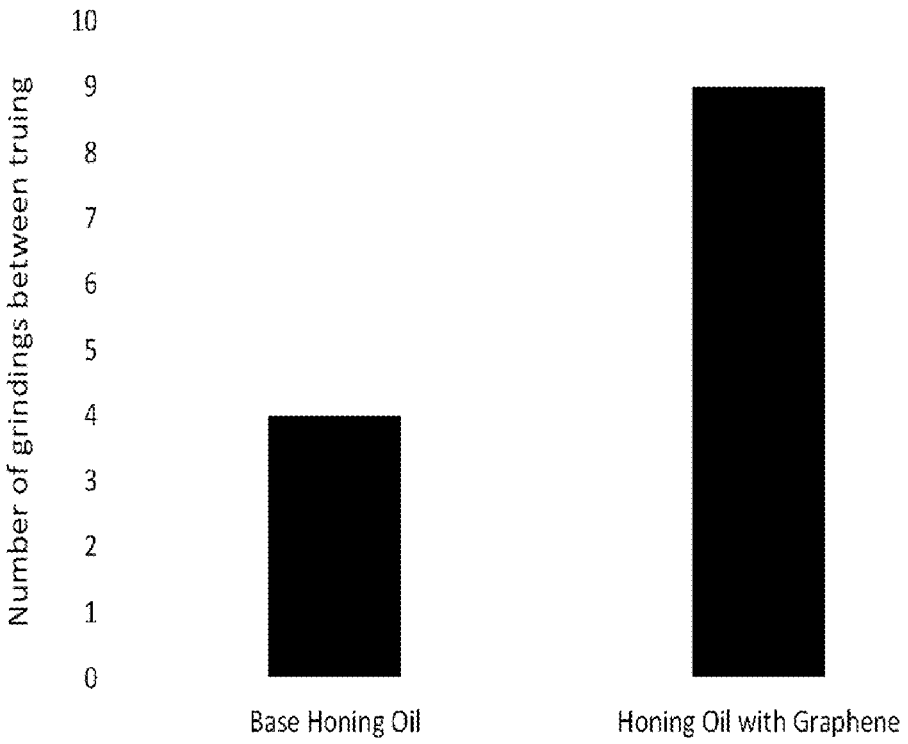
FIG. 4 is a graph showing the results of experiments using an inventive graphene-based lubricant for honing/grinding.

In one exemplary embodiment, graphene nanoplatelet with an average diameter of 7 microns is added to a regular honing oil at a concentration in the range of 0.1-5 wt %, more preferably in the range of 0.5-3 wt %, and yet more preferably 1-2 wt %, to grind fuel injector casings. The honing wheel is trued first and then grinding is done using regular honing oil with and without graphene additive. In this case, the graphene additive is added to the honing oil as a concentrate, followed by 15 minute of simple mixing. By adding graphene, the number of fuel injector casings that could be processed between truing is more than doubled from an average of 4 to a range of 8-10, as shown in FIG. 4. Therefore, adding graphene type materials in the honing oil significantly reduces the wear of honing wheel and improves the productivity.

Exemplary Embodiment 2

In another exemplary embodiment, graphene nanoplatelet with surface area in the range of 300-750 $m^2/g$ is used as an additive to extend operating conditions on conventional engine lubricants. The additive at a concentration in the range of 0.1-5 wt %, preferably 0.1-1 wt %, and yet more preferably 0.1-0.5 wt %, can help lower friction and reduce parasitic friction losses in engines. It can also form thin protective tribofilms on lubricated surfaces, thereby reducing component wear. Four groups of lubricants with graphene nanoplatelets are prepared to compare with a base oil: (i) the base oil plus a commercial Additive 1; (ii) the base oil plus graphene nanoplatelet; (iii) the base oil plus both commercial Additive 1 and graphene nanoplatelet; and (iv) the base oil plus a commercial Additive 2 and graphene nanoplatelet. Tribology test is performed using a ball-on flat method with the ball being a hardened 5210 ball of ½" diameter and the flat being hardened 52100 and mirror polished with a dimension of 1.5"×2". A load of 15.6N is applied by deadweight. The stroke length is 2 cm and peak constant pressure is 1 GPa. The flat temperature is at 100° C. Table 1 summarizes the results. The addition of graphene effectively reduces both friction and wear as compared to base oil. When an appropriate additive is used in combination with graphene, the package shows a synergistic and more effectively improved both friction and wear performance of the engine lubricant.

TABLE 1

| | Avg, COF | Ball Wear (um^3) | Friction | Wear |
|---|---|---|---|---|
| Oil A | 0.125 | 209000 | High | High |
| Oil A + XG Graphene | 0.075 | (1100) | Moderate | Low |
| Oil A + Additive 1 | 0.0625 | 1900 | Moderate | Moderate |
| Oil A + XG Graphene + Additive 1 | 0.032 | 2400 | Low | Moderate |
| Oil A + XG Graphene + Additive 2 | 0.037 | (260) | Low | Low |

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient roadmap for implementing the exemplary embodiment or exemplary embodiments. It should be understood that various changes may be made in the function and arrangement of elements without departing from the scope as set forth in the appended claims and the legal equivalents thereof.

The invention claimed is:

1. A graphene-based lubricant comprising:

a graphene-based additive having a surface area in the range of 300-800 $m^2/g$;

a base liquid in which the graphene-based additive is dispersed; and other additives dispersed in the base liquid, wherein the graphene-based additive includes one or more surfactants comprising sulfonates, sulfates, polysaccharides, maleic anhydride grafted polyolefins, polyethylene glycols, or styrene acrylics bonded to the surface of the graphene.

2. The graphene-based lubricant of claim 1, wherein the graphene-based additive comprises one or more of single-layer graphene, double-layer graphene, few-layer graphene (FLG), graphene nanoplatelets (GNP), graphene oxide (GO), reduced graphene oxide (rGO), functionalized graphene, and doped graphene.

3. The graphene-based lubricant of claim 1, wherein the graphene-based additive is made by mechanical exfoliation of graphite.

4. The graphene-based lubricant of claim 1, wherein the graphene-based additive has an average particle size of <5 microns.

5. The graphene-based lubricant of claim 1, wherein the graphene-based additive has an oxygen content in the range of 2-20 wt %.

6. The graphene-based lubricant of claim 1, wherein the graphene-based additive is made by chemical exfoliation of graphite.

7. The graphene-based lubricant of claim 1, wherein the graphene-based additive has a particle size in the range of 0.1-50 microns.

8. The graphene-based lubricant of claim 1, wherein the base liquid is an oil-based solvent or mixture or an aqueous based solvent.

9. The graphene-based lubricant of claim 1, wherein the graphene-based additive content is in the range of 0.1-2 wt %.

10. The graphene-based lubricant of claim 8, wherein the oil-based solvent or mixture has a viscosity index range of 80 to 120 and an operating temperature range of from 32° F. to 150° F.

11. The graphene-based lubricant of claim 8, wherein the oil-based solvent comprises one or more of synthetic poly-alphaolefins (PAOs).

12. The graphene-based lubricant of claim 1, further comprising a dispersant, wherein the dispersant is selected from the group consisting of sulfonates, sulfates, phosphonates, phosphates, fatty acids, naphthenic acids, fatty amides, organic alcohols, succinimides, succinate esters, polysaccharides, maleic anhydride, maleic anhydride grafted polyolefins, polyols, polyethylene glycols (PEG), PEG based copolymers, polyacrylic acids (PAA), polyvinyl chloride (PVC), phenoxy ethers, styrene acrylics, and a mixture of any of the above, wherein the amount of dispersant in the final lubricant formulation is in the range of 1 to 20 wt %.

13. The graphene-based lubricant of claim 8, wherein the oil-based solvent comprises one or more of silicone, phosphate ester, polyalkylene glycol (PAG), polyolester, and biolubes with or without a dispersant.

14. The graphene-based lubricant of claim 13, further comprising a dispersant, wherein the dispersant is selected from the group consisting of sulfonates, sulfates, phosphonates, phosphates, fatty acids, naphthenic acids, fatty amides, organic alcohols, succinimides, succinate esters, polysaccharides, maleic anhydride, maleic anhydride grafted polyolefins, polyols, polyethylene glycols (PEG), PEG based copolymers, polyacrylic acids (PAA), polyvinyl chloride (PVC), phenoxy ethers, styrene acrylics, and a mixture of any of the above, wherein the amount of dispersant in the final lubricant formulation is in the range of 1 to 20 wt %.

15. The graphene-based lubricant of claim 1, wherein the base liquid is an aqueous solvent.

16. A method of lubrication comprising:

applying a composition according to claim 1 to two mating surfaces to form a protective coating between the two mating surfaces.

* * * * *